US007950761B2

(12) United States Patent
Komatsu et al.

(10) Patent No.: US 7,950,761 B2
(45) Date of Patent: May 31, 2011

(54) LIQUID DISCHARGING APPARATUS AND METHOD FOR OBTAINING A LARGE LIQUID DROPLET DETECTION SIGNAL

(75) Inventors: Shinya Komatsu, Shiojiri (JP); Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 246 days.

(21) Appl. No.: 12/208,062

(22) Filed: Sep. 10, 2008

(65) Prior Publication Data

US 2009/0066741 A1 Mar. 12, 2009

(30) Foreign Application Priority Data

Sep. 11, 2007 (JP) ..... 2007-235337

(51) Int. Cl.
*B41J 29/38* (2006.01)
*B41J 29/393* (2006.01)

(52) U.S. Cl. ..... 347/11; 347/19

(58) Field of Classification Search ..... 347/11
See application file for complete search history.

(56) References Cited

U.S. PATENT DOCUMENTS 5,510,816 A * 4/1996 Hosono et al. ..... 347/10
6,203,132 B1 * 3/2001 Tsukada et al. ..... 347/11
6,290,315 B1 * 9/2001 Sayama ..... 347/11
6,290,317 B1 * 9/2001 Hotomi ..... 347/11
7,490,920 B2 * 2/2009 Usuda ..... 347/11
2003/0029379 A1 * 2/2003 Onogawa et al. ..... 118/621
2005/0212844 A1 * 9/2005 Nishihara ..... 347/19
2006/0176329 A1 * 8/2006 Usui ..... 347/11
2006/0232622 A1 * 10/2006 Nishihara et al. ..... 347/19
2007/0076029 A1 * 4/2007 Komatsu ..... 347/9
2010/0053244 A1 * 3/2010 Izuo et al. ..... 347/10

FOREIGN PATENT DOCUMENTS

JP 2007-118571 5/2007

* cited by examiner

*Primary Examiner* — Shelby Fidler
(74) *Attorney, Agent, or Firm* — Workman Nydegger

(57) ABSTRACT

A liquid discharging apparatus includes a discharging device, a liquid receiving device, a voltage applying device, an electrical change detection device, a driving signal generating device, and a control device. The discharging device discharges liquid from a nozzle to a target on the basis of discharge data. At the time of discharging, the control device controls the discharging device so as to perform discharging on the basis of the discharge data using a generated discharge data driving signal. At the time of the nozzle testing, the control device controls the voltage applying device so as to apply a predetermined voltage between the discharging device and the liquid receiving device and controls the discharging device using a test driving signal to determine on the basis of an electrical change detected by the electrical change detection device whether the liquid is discharged to thereby perform the nozzle testing.

8 Claims, 8 Drawing Sheets

LIQUID DISCHARGING APPARATUS AND METHOD FOR OBTAINING A LARGE LIQUID DROPLET DETECTION SIGNAL

BACKGROUND

1. Technical Field

The invention relates to a liquid discharging apparatus and a method of controlling the same.

2. Related Art

In an existing art, an ink jet printer is proposed as a liquid discharging apparatus, in which a voltage change that occurs when electrically charged ink droplets are discharged from nozzles of the print head to an ink receiving area is detected by a voltage detection circuit to perform head testing as to whether ink is normally discharged from the nozzles, which is, for example, described in JP-A-2007-118571. The ink jet printer described in JP-A-2007-118571 discharges a plurality of ink droplets from a nozzle to thereby obtain a sufficiently large output waveform at the time of head testing.

The ink jet printer described in JP-A-2007-118571 is able to obtain a sufficiently large output waveform at the time of head testing; however, it is necessary to discharge a plurality of ink droplets. This may not be effectively obtaining a detection signal.

SUMMARY

An advantage of some aspects of the invention is that it provides a liquid discharging apparatus that is able to effectively obtain a further large detection signal at the time of testing as to whether liquid is able to be discharged from a nozzle, and a method of controlling the liquid discharging apparatus.

An aspect of the invention is provided in the following manner.

An aspect of the invention provides a liquid discharging apparatus. The liquid discharging apparatus includes a discharging device, a liquid receiving device, a voltage applying device, an electrical change detection device, a driving signal generating device, and a control device. The discharging device is able to discharge liquid from a nozzle to a target on the basis of discharge data. The liquid receiving device receives liquid discharged from the nozzle. The voltage applying device applies a predetermined voltage between the discharging device and the liquid receiving device. The electrical change detection device detects at least one of an electrical change in the discharging device and an electrical change in the liquid receiving device. The driving signal generating device generates, at the time of discharging on the basis of the discharge data, a predetermined discharge data driving signal to drive the discharging device and, at the time of nozzle testing in which it is tested whether the liquid is able to be discharged from the nozzle, a test driving signal to drive the discharging device so that the liquid immediately before being discharged from the nozzle protrudes from the nozzle while maintaining electrical continuity with the discharging device to thereby be discharged from the nozzle as a liquid droplet after a distance between the liquid and the liquid receiving area is reduced as compared with that at the time of discharging on the basis of the discharge data. At the time of discharging on the basis of the discharge data, the control device controls the discharging device so as to perform discharging on the basis of the discharge data using the generated discharge data driving signal, whereas, at the time of the nozzle testing, the control device controls the voltage applying device so as to apply the predetermined voltage between the discharging device and the liquid receiving device and controls the discharging device using the generated test driving signal to determine on the basis of an electrical change detected by the electrical change detection device whether the liquid is discharged to thereby perform the nozzle testing.

The above liquid discharging apparatus, at the time of discharging on the basis of discharge data, generates a predetermined discharge data driving signal to drive the discharging device and, at the time of nozzle testing in which it is tested whether liquid is able to be discharged from the nozzle, generates a detection driving signal to drive the discharging device so that the liquid immediately before being discharged from the nozzle protrudes from the nozzle while maintaining electrical continuity with the discharging device to thereby be discharged from the nozzle as a liquid droplet after a distance between the liquid and the liquid receiving area is reduced as compared with that at the time of discharging on the basis of the discharge data. Then, the discharging device is controlled to perform discharging on the basis of generated discharge data at the time of discharging on the basis of discharge data, whereas, at the time of the nozzle testing, the nozzle testing is performed so that a predetermined voltage is applied between the discharging device and the liquid receiving device, and the discharging device is controlled using the generated test driving signal to thereby determine on the basis of at least one of an electrical change in the discharging device and an electrical change in the liquid receiving device whether liquid is discharged. In this way, because the liquid immediately before being discharged is located closer to the liquid receiving device than that at the time of discharging on the basis of discharge data (hereinafter, referred to as at the time of discharge-data discharging) while maintaining electrical continuity with the discharging device, when the liquid is discharged as a liquid droplet thereafter, the liquid droplet is electrically charged with more electric charges than that when testing is performed using the same driving signal as that at the time of discharge-data discharging. Thus, an electrical change detected by the electrical change detection device is also larger than that when testing is performed using the same driving signal as that at the time of discharge-data discharging. Hence, it is possible to effectively obtain a further large detection signal when it is tested whether liquid is able to be discharged from the nozzle. Here, the "predetermined discharge data driving signal" may include a preset signal change by which liquid is able to be discharged from a nozzle. In addition, the "predetermined voltage" may be empirically determined from the range of an electrical change, which is able to be detected by the electrical change detection device.

In the liquid discharging device according to the aspect of the invention, the discharging device may include: a liquid chamber that is in fluid communication with the nozzle and that temporarily contains the liquid; and a piezoelectric element that deforms the liquid chamber by applying a pressure to the liquid chamber in such a manner that a voltage based on the discharge data driving signal or the test driving signal is applied to the piezoelectric element to thereby make the liquid be discharged from the nozzle, wherein the driving signal generating device may generate an electrical signal that includes, as the discharge data driving signal, a pressurization voltage change that makes the piezoelectric element deform so as to reduce the volume of the liquid chamber and a separation voltage change that, after the pressurization voltage change, separates liquid, which will be discharged from the nozzle, from liquid that remains in the liquid chamber, and may generate an electrical signal that includes, as the test driving signal, a pressurization voltage change that makes the piezoelectric element deform so as to reduce the volume of the liquid chamber and a separation voltage change that, after the pressurization voltage change, separates liquid, which will be discharged from the nozzle, from liquid that remains in the liquid chamber, the electrical signal having a ratio of the separation voltage change to the pressurization voltage change in the test driving signal, which is smaller than a ratio of the separation voltage change to the pressurization voltage change in the discharge data driving signal. In this manner, at the time of nozzle testing, by using a driving signal that has a small ratio of the separation voltage change to the pressurization voltage change, that is, by weakening separation between liquid that remains in the liquid chamber and liquid immediately before being discharged, it is possible to relatively easily reduce a distance between the ink immediately before being discharged and the ink receiving area as compared with that at the time of normal printing. Here, to generate an electrical signal of which the ratio of the separation voltage change to the pressurization voltage change in the test driving signal is smaller than the ratio of the separation voltage change to the pressurization voltage change in the discharge data driving signal, the electrical signal may be generated so as to include, as the test driving signal, a separation voltage change that is smaller than a separation voltage change included in the discharge data driving signal. In the above aspect, the driving signal generating device may generate, as the discharge data driving signal, an electrical signal that changes to a pressurization voltage, which is a voltage after the pressurization voltage change, through the pressurization voltage change and then changes to a predetermined discharge data intermediate voltage through the separation voltage change, and may generate, as the test driving signal, an electrical signal that changes to a pressurization voltage, which is a voltage after the pressurization voltage change, through the pressurization voltage change and then changes to a test intermediate voltage, which is a voltage between the pressurization voltage and the discharge data intermediate voltage, through the separation voltage change, so that the ratio of the separation voltage change to the pressurization voltage change in the test driving signal is smaller than the ratio of the separation voltage change to the pressurization voltage change in the discharge data driving signal. Here, the "discharge data intermediate voltage" may be set as a voltage at the time when the operation of discharging liquid is not performed. In the above aspect, the driving signal generating device may generate, as the test driving signal, an electrical signal that uses the discharge data intermediate voltage as a reference, and that changes to the pressurization voltage through the pressurization voltage change, changes to the test intermediate voltage and then changes to the discharge data intermediate voltage. In this manner, the discharging device may be driven by using the discharge data intermediate voltage as a reference. Here, the phrase "using the discharge data intermediate voltage as a reference" means that a voltage at the time when the operation of discharging liquid is not performed is set as the discharge data intermediate voltage. Alternatively, the driving signal generating device may generate, as the test driving signal, an electrical signal that uses the test intermediate voltage as a reference, and that changes to the pressurization voltage through the pressurization voltage change and then changes to the test intermediate voltage. In this manner, the discharging device may be driven by using the test intermediate voltage as a reference. Here, the phrase "using the test intermediate voltage as a reference" means that a voltage at the time when the operation of discharging liquid is not performed is set as the test intermediate voltage.

In the liquid discharging device according to the aspect of the invention, the discharging device may include: a liquid chamber that is in fluid communication with the nozzle and that temporarily contains the liquid; and a piezoelectric element that deforms the liquid chamber by applying a pressure to the liquid chamber in such a manner that a voltage based on the discharge data driving signal or the test driving signal is applied to the piezoelectric element to thereby make the liquid be discharged from the nozzle, wherein the driving signal generating device may generate an electrical signal that includes, as the discharge data driving signal, a pressurization voltage change that makes the piezoelectric element deform so as to reduce the volume of the liquid chamber and a separation voltage change that, after the pressurization voltage change, separates liquid, which will be discharged from the nozzle, from liquid that remains in the liquid chamber, and may generate an electrical signal that includes, as the test driving signal, the separation voltage change of which the amount per unit time is smaller than that of the separation voltage change included in the discharge data driving signal. In this manner, at the time of nozzle testing, by using a test driving signal that includes the separation voltage change of which the amount per unit time is small, that is, by weakening separation between liquid that remains in the liquid chamber and liquid immediately before being discharged, it is possible to relatively easily reduce a distance between the ink immediately before being discharged and the ink receiving area as compared with that at the time of normal printing.

In the liquid discharging device according to the aspect of the invention, the discharging device may include: a liquid chamber that is in fluid communication with the nozzle and that temporarily contains the liquid; and a piezoelectric element that deforms the liquid chamber by applying a pressure to the liquid chamber in such a manner that a voltage based on the discharge data driving signal or the test driving signal is applied to the piezoelectric element to thereby make the liquid be discharged from the nozzle, wherein the driving signal generating device may generate an electrical signal that includes, as the discharge data driving signal, a pressurization voltage change that makes the piezoelectric element deform so as to reduce the volume of the liquid chamber in order to push out liquid, which will be discharged from the nozzle, from the liquid chamber, and may generate an electrical signal that includes, as the test driving signal, a pressurization voltage change of which the amount is larger than that of the pressurization voltage change included in the discharge data driving signal. In this manner, by using a test driving signal of which the amount of the pressurization voltage change is large, that is, by increasing the amount of liquid that protrudes from the nozzle and immediately before being discharged, it is possible to relatively easily reduce a distance between the ink immediately before being discharged and the ink receiving area as compared with that at the time of normal printing.

Another aspect of the invention provides a method of controlling a liquid discharging apparatus having a discharging device that is able to discharge liquid from a nozzle to a target and a liquid receiving device that receives liquid discharged from the nozzle. The method includes: at the time of discharging on the basis of discharge data, generating a predetermined discharge data driving signal to drive the discharging device; at the time of nozzle testing in which it is tested whether the liquid is able to be discharged from the nozzle, generating a test driving signal to drive the discharging device so that the liquid immediately before being discharged from the nozzle protrudes from the nozzle while maintaining electrical continuity with the discharging device to thereby be discharged from the nozzle as a liquid droplet after a distance between the liquid and the liquid receiving area is reduced as compared with that at the time of discharging on the basis of the discharge data; at the time of discharging on the basis of the discharge data, controlling the discharging device so as to perform discharging on the basis of the discharge data using the generated discharge data driving signal; and at the time of the nozzle testing, applying a predetermined voltage between the discharging device and the liquid receiving device and controlling the discharging device using the generated test driving signal to determine on the basis of at least one of an electrical change in the discharging device and an electrical change in the liquid receiving device whether the liquid is discharged to thereby perform the nozzle testing.

The above method, at the time of discharging on the basis of discharge data, generates a predetermined discharge data driving signal to drive the discharging device and, at the time of nozzle testing in which it is tested whether liquid is able to be discharged from the nozzle, generates a detection driving signal to drive the discharging device so that the liquid immediately before being discharged from the nozzle protrudes from the nozzle while maintaining electrical continuity with the discharging device to thereby be discharged from the nozzle as a liquid droplet after a distance between the liquid and the liquid receiving area is reduced as compared with that at the time of discharging on the basis of the discharge data. Then, at the time of discharging on the basis of discharge data, the discharging device is controlled to perform discharging on the basis of generated discharge data, whereas, at the time of the nozzle testing, the nozzle testing is performed so that a predetermined voltage is applied between the discharging device and the liquid receiving device, and the discharging device is controlled using the generated test driving signal to thereby determine on the basis of at least one of an electrical change in the discharging device and an electrical change in the liquid receiving device whether liquid is discharged. In this way, because the liquid immediately before being discharged is located closer to the liquid receiving device than that at the time of discharge-data discharging while maintaining electrical continuity with the discharging device, when the liquid is discharged as a liquid droplet thereafter, the liquid droplet is electrically charged with more electric charges than that when testing is performed using the same driving signal as that at the time of discharge-data discharging. Thus, a detected electrical change is also larger than that when testing is performed using the same driving signal as that at the time of discharge-data discharging. Hence, it is possible to effectively obtain a further large detection signal when it is tested whether liquid is able to be discharged from the nozzle. Note that the above method may add a step or steps that implement the function(s) of the above described liquid discharging apparatus. In addition, the above described method may be implemented as a program that is executed on one or more computers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
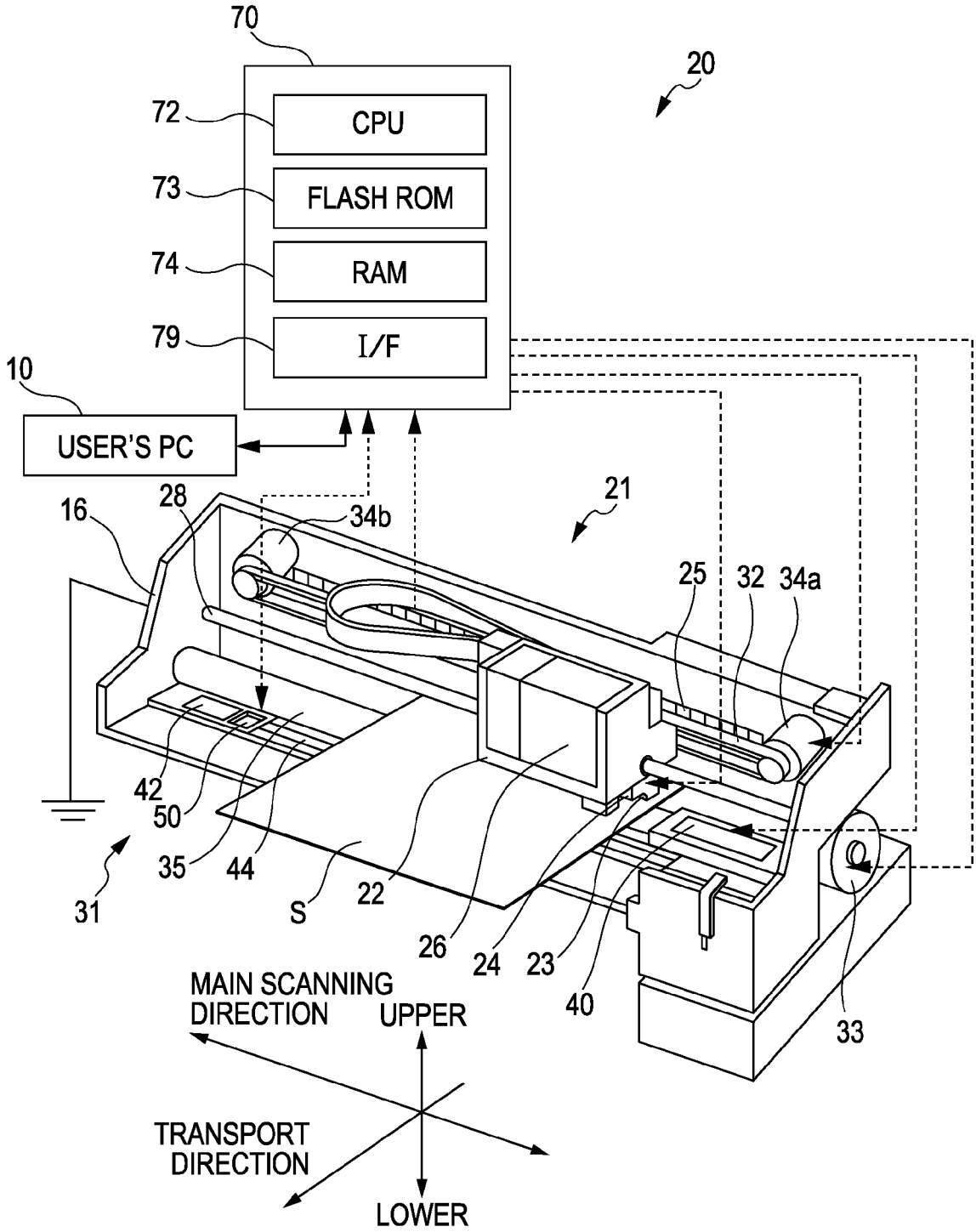
FIG. 1 is a configuration diagram that shows the schematic configuration of an ink jet printer.
Figure 2:
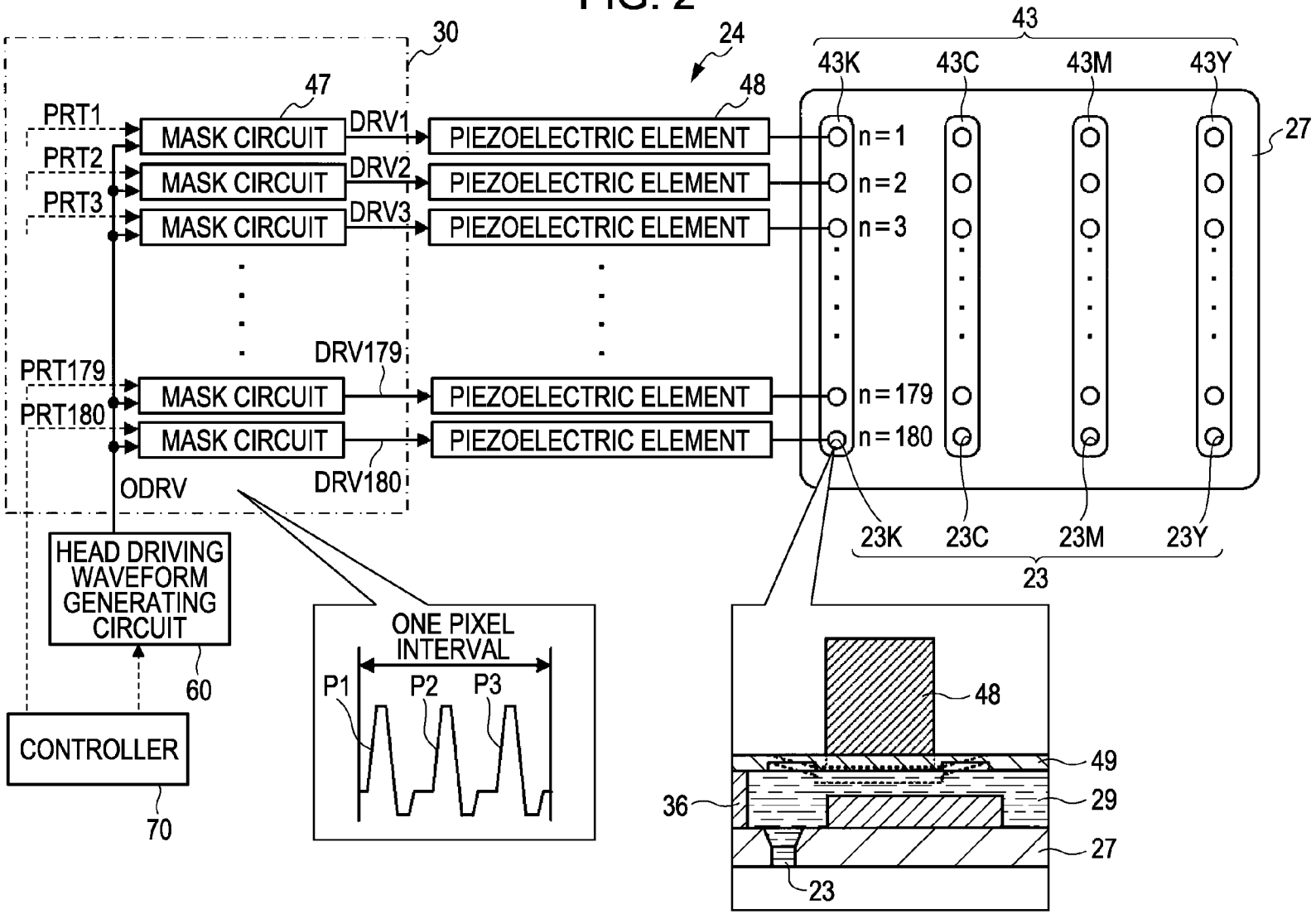
FIG. 2 is a view that illustrates a print head.
Figure 3:
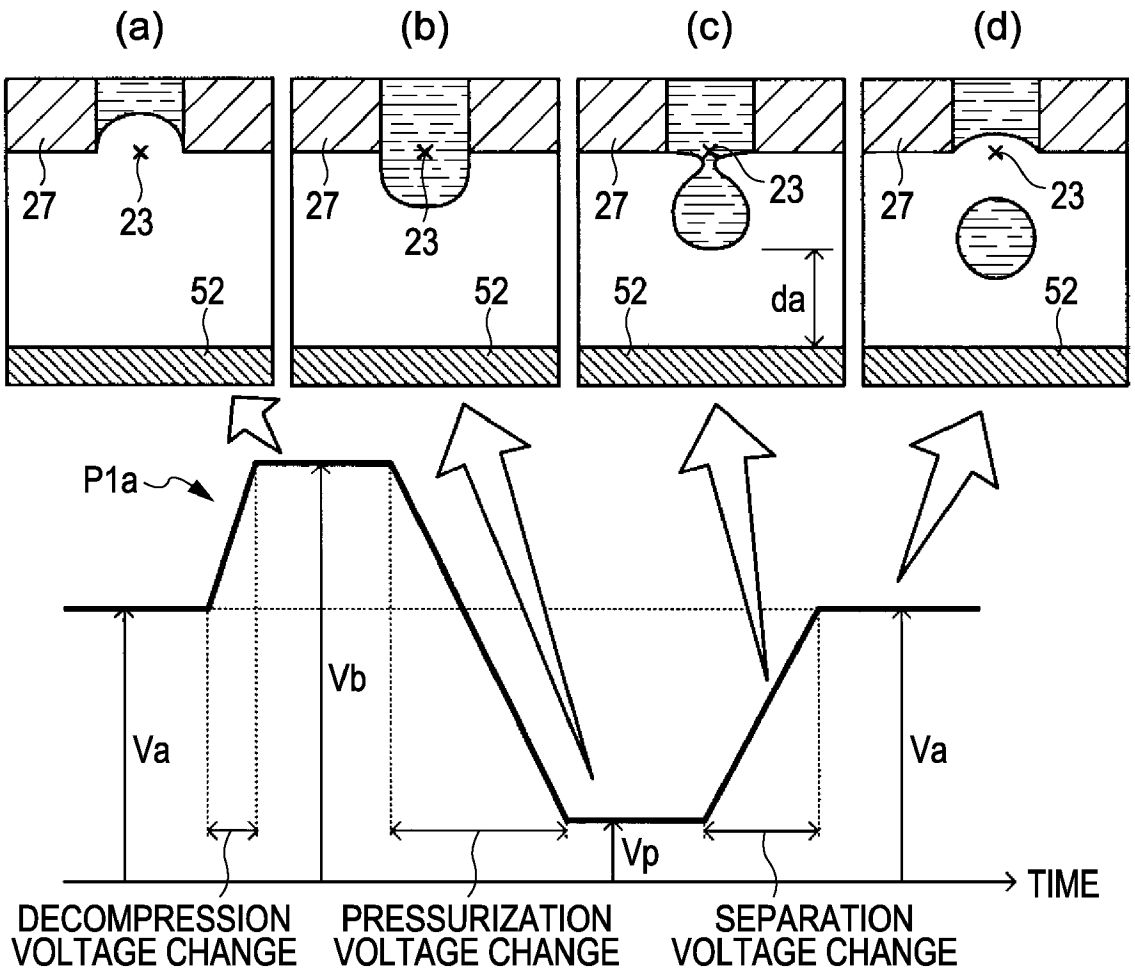
FIG. 3 is a view that illustrates an example of an original signal at the time of normal printing.
Figure 4:
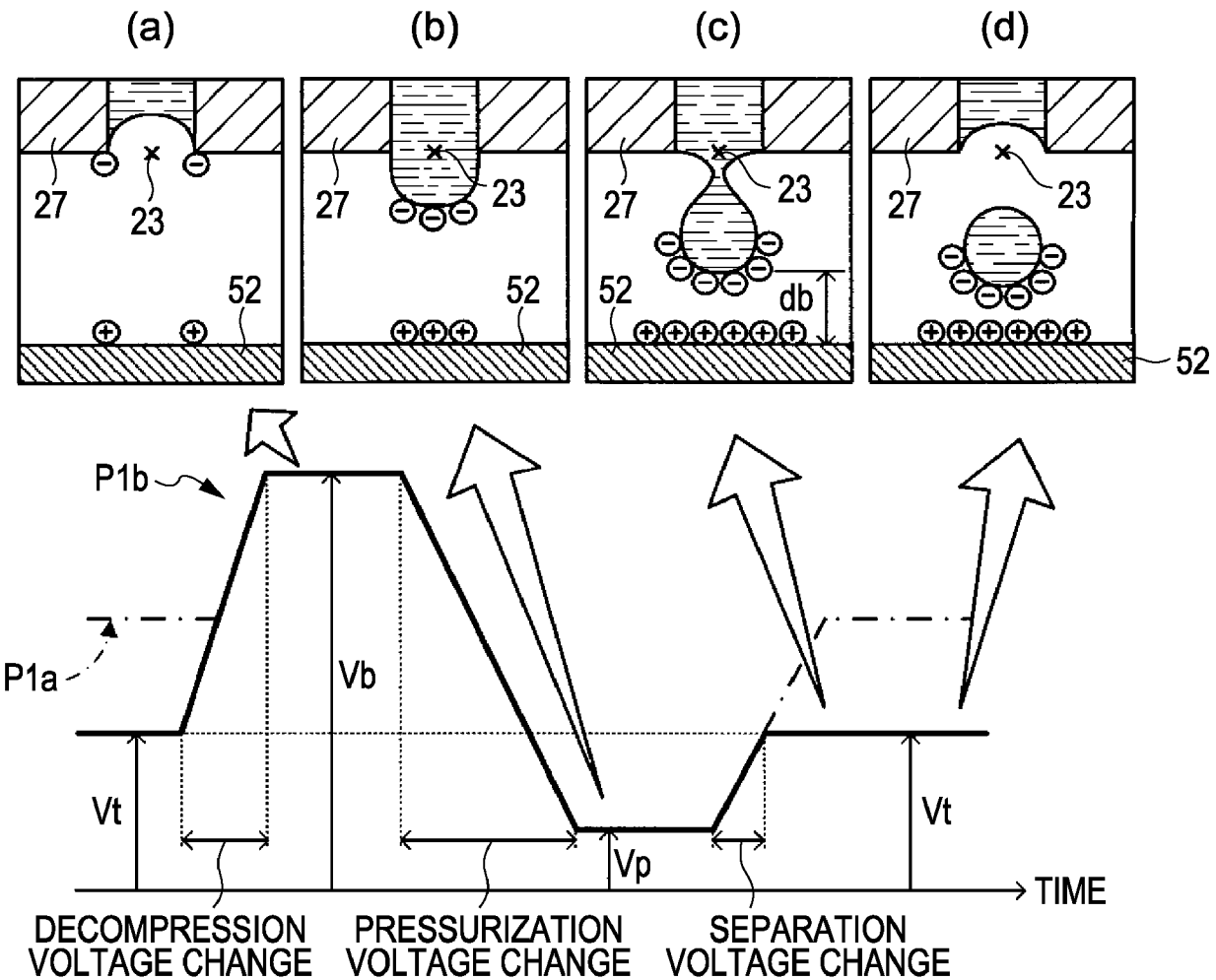
FIG. 4 is a view that illustrates an example of an original signal at the time of nozzle testing.
Figure 5:
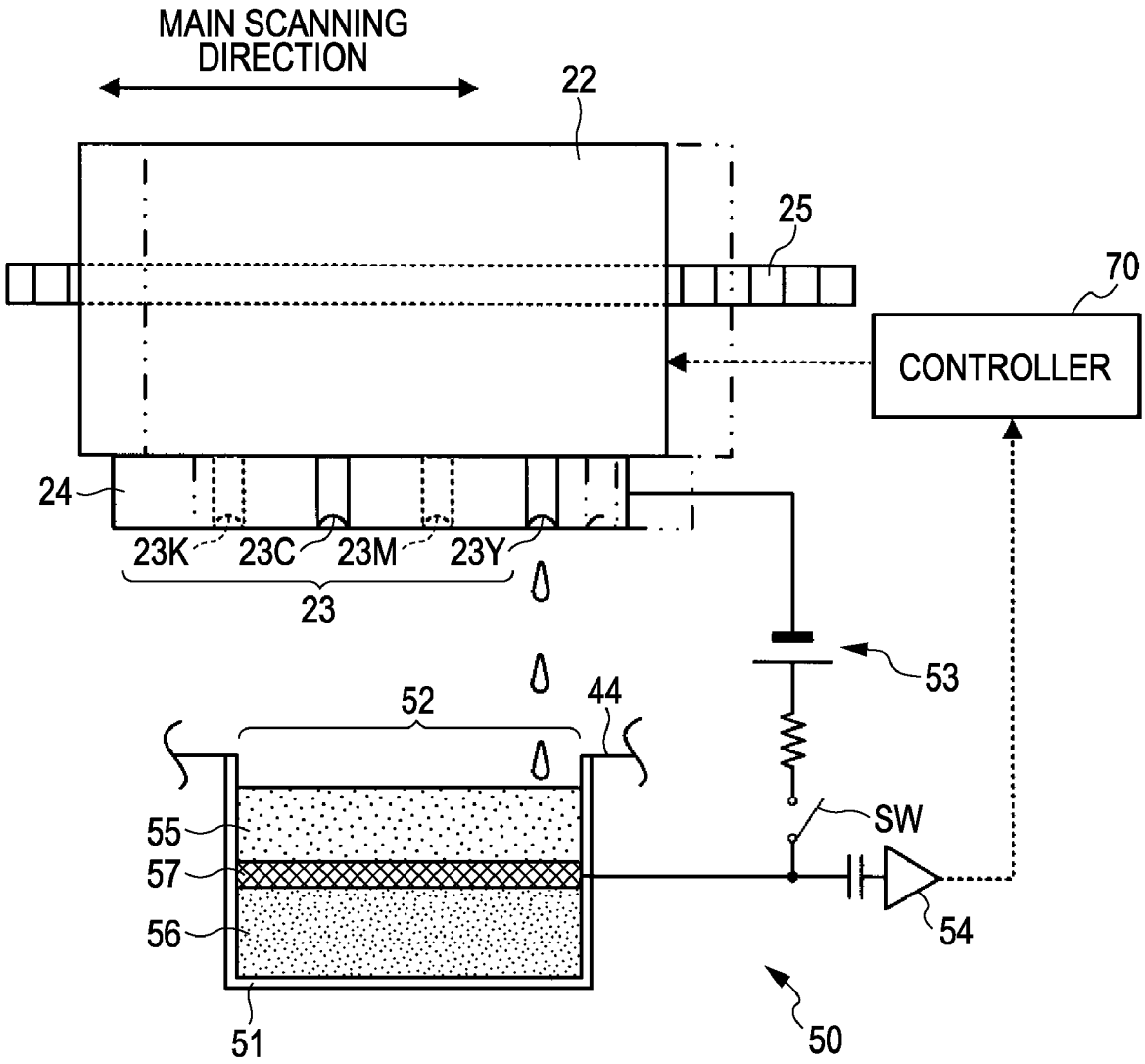
FIG. 5 is a configuration diagram that schematically shows the configuration of a nozzle test device.

An embodiment according to the invention will now be described. FIG. 1 is a configuration diagram that shows the schematic configuration of an ink jet printer 20. FIG. 2 is a view that illustrates the electrical connection of a print head 24. FIG. 3 is a view that illustrates an original signal ODRVa that is used when a normal print job is performed. FIG. 4 is a view that illustrates an original signal ODRVb when a nozzle 23 is tested. FIG. 5 is a configuration diagram that schematically shows the configuration of a nozzle test device 50.

As shown in FIG. 1, the ink jet printer 20 of the present embodiment includes a paper feeding mechanism 31, a printer mechanism 21, a capping device 40, a flushing area 42, a nozzle test device 50 and a controller 70. The paper feeding mechanism 31 transports a recording sheet S from the rear side to the front side (transport direction) in the drawing by a paper feed roller 35 being driven by a drive motor 33. The printer mechanism 21 discharges ink droplets from the print head 24 toward the recording sheet S that is transported onto a platen 44 by the paper feeding mechanism 31 to perform printing. The capping device 40 is formed at the right-hand end of the platen 44, seals the print head 24 and vacuums ink inside the print head 24 using a pump (not shown) where necessary to thereby perform cleaning. The flushing area 42 is formed at the left-hand end of the platen 44 in the drawing and is used to perform flushing operation for discharging ink droplets at a predetermined timing regardless of print data in order to prevent ink from being dried and solidified at nozzle distal ends of the print head 24. The nozzle test device 50 is formed next to the flushing area 42 on the platen 44 and executes nozzle testing as to whether ink droplets are discharged from the nozzles 23 of the print head 24. The controller 70 controls the entire ink jet printer 20.

The printer mechanism 21 includes a carriage motor 34*a*, a driven roller 34*b*, a carriage belt 32, a carriage 22, an ink cartridge 26, and a print head 24. The carriage motor 34*a* is arranged at the right-hand side of a mechanical frame 16. The driven roller 34*b* is arranged at the left-hand side of the mechanical frame 16. The carriage belt 32 is suspended between the carriage motor 34*a* and the driven roller 34*b*. The carriage 22 reciprocally moves from side to side (main scanning direction) along a guide 28 by the carriage belt 32 being driven by the carriage motor 34*a*. The ink cartridge 26 is mounted on the carriage 22 and individually contains yellow (Y) ink, magenta (M) ink, cyan (C) ink and black (K) ink, each of which is formed of water, as a solvent, and dye or pigment, as a coloring agent, contained in the water. The print head 24 is supplied with ink from the ink cartridge 26 and discharges ink droplets. Incidentally, a linear encoder 25 that detects the position of the carriage 22 is arranged on the rear side of the carriage 22. This linear encoder 25 manages the position of the carriage 22. As shown in FIG. 2, the print head 24 includes a stainless nozzle plate 27, a cavity plate 36, ceramic (for example, zirconia ceramic) diaphragms 49, piezoelectric elements 48 (for example, lead zirconate titanate), and mask circuits 47. The nozzle plate 27 has four columns of nozzle arrays 43C, 43M, 43Y and 43K, which respectively include a plurality of cyan (C) nozzles 23C, a plurality of magenta (M) nozzles 23M, a plurality of yellow (Y) nozzles 23Y, and a plurality of black (K) nozzles 23K that are arranged in a column (the number of nozzles is 180 for each column in the present embodiment). The cavity plate 36 cooperates with the nozzle plate 27 to form ink chambers 29 that are respectively in fluid communication with the nozzles 23. The diaphragms 49 each form a top wall of a corresponding one of the ink chambers 29. The piezoelectric elements 48 are attached to the upper face of the corresponding diaphragms 49. The mask circuits 47 are formed on a head driving substrate 30 and serve as driving circuits, each of which outputs a driving signal to the corresponding piezoelectric element 48. A voltage is applied from the mask circuit 47 to the corresponding piezoelectric element 48 to thereby press the upper wall of the ink chamber 29 downward with the piezoelectric element 48, thus pressurizing ink to discharge an ink droplet. Here, the nozzles 23C, 23M, 23Y and 23K are collectively termed as nozzles 23, and the nozzle arrays 43C, 43M, 43Y and 43K are collectively termed as nozzle arrays 43. Hereinafter, driving of the print head 24 will be described using the black (K) nozzles 23K.

Each mask circuit 47 receives an original signal ODRV and a printing signal PRTn, which are generated by the head driving waveform generating circuit 60, and generates a driving signal DRVn on the basis of the received original signal ODRV and printing signal PRTn and then outputs the driving signal DRVn to the corresponding piezoelectric element 48. Note that the suffix n of the printing signal PRTn and the suffix n of the driving signal DRVn are numbers used for identifying a nozzle included in a nozzle array. In the present example embodiment, each nozzle array consists of 180 nozzles, so that n is an integer in the range of 1 to 180.

The head driving waveform generating circuit 60 outputs, to each of the mask circuits 47, a signal formed in units of three repetition pulses of a first pulse P1, a second pulse P2 and a third pulse P3 within one pixel interval (a period of time during which the carriage 22 crosses over one pixel) as an original signal ODRV of the black ink nozzle array 43K. At this time, the original signal ODRVa used for processing a normal print job is a signal that includes a first pulse P1*a*, as shown in FIG. 3, and a second pulse P2*a* and third pulse P3*a* similar to the first pulse P1*a*. As shown in the drawing, the first pulse P1*a* of the original signal ODRVa at the time of normal printing is set to change from a normal intermediate voltage Va to a decompression voltage Vb, which is higher than the normal intermediate voltage Va, through a decompression voltage change, subsequently change to a pressurization voltage Vp, which is lower than the normal voltage Va, through a pressurization voltage change and then change to the normal intermediate voltage Va again through a separation voltage change. The original signal ODRVb at the time of execution of nozzle testing, which will be described later, as to whether ink is discharged from the nozzles 23 is an signal that includes a first pulse P1*b*, as shown in FIG. 4, and a second pulse P2*b* and third pulse P3*b* similar to the first pulse P1*b*. As shown in the drawing, the first pulse P1*b* of the original signal ODRVb at the time of nozzle testing is formed so that the above described normal intermediate voltage Va of the original signal ODRVa at the time of normal printing is replaced with a test intermediate voltage Vt, which is a voltage between the pressurization voltage Vp and the normal intermediate voltage Va, and is set to change from the test intermediate voltage Vt to the decompression voltage Vb, which is higher than the test intermediate voltage Vt, through a decompression voltage change, subsequently change to the pressurization voltage Vp, which is lower than the test intermediate voltage Vt, through a pressurization voltage change and then change to the test intermediate voltage Va again through a separation voltage change. As described above, the original signal ODRVa at the time of normal printing and the original signal ODRVb at the time of nozzle testing are set so that the amount of the pressurization voltage change is equal between the original signal ODRVa and the original signal ODRVb and the amount of the separation voltage change is smaller in the original signal ODRVb than in the original signal ODRVa. Thus, the ratio of the separation voltage change to the pressurization voltage change in the original signal ODRVb at the time of nozzle testing is set to be smaller than the ratio of the separation voltage change to the pressurization voltage change in the original signal ODRVa at the time of normal printing. Hereinafter, the original signal ODRVa and the original signal ODRVb are collectively termed as the original signal ODRV, the first pulses P1*a* and P1*b* are collectively termed as the first pulse P1, the second pulses P2*a* and P2*b* are collectively termed as the second pulse P2, and the third pulses P3*a* and P3*b* are collectively termed as the third pulse P3. As shown in FIG. 2, each mask circuit 47 masks an unnecessary pulse among the three pulses included in an input original signal ODRV on the basis of a separately input printing signal PRTn to thereby output only a necessary pulse to the piezoelectric element 48 of the corresponding nozzle 23K as the driving signal DRVn. At this time, as only the first pulse P1 is output to the piezoelectric element 48 as the driving signal DRVn, a one-shot ink droplet is discharged from the nozzle 23K to form a small-size dot (small dot) on the recording sheet S. As the first pulse P1 and the second pulse P2 are output to the piezoelectric element 48, two-shot ink droplets are discharged from the nozzle 23K to form a middle-size dot (middle dot) on the recording sheet S. As the first pulse P1, second pulse P2 and third pulse P3 are output to the piezoelectric element 48, three-shot ink droplets are discharged from the nozzle 23K to form a large-size dot (large dot) on the recording sheet S. In this way, the ink jet printer 20 is able to form three sizes of dots by adjusting the amount of ink discharged during one pixel interval. Note that the other color ink nozzles 23C, 23M and 23Y and nozzle arrays 43C, 43M and 43Y are similar to the black (K) ink nozzle 23K and nozzle array 43K, respectively.

As shown in FIG. 5, the nozzle test device 50 includes a test box 51, an ink receiving area 52, a voltage applying circuit 53 and a voltage detection circuit 54. The test box 51 is able to receive ink droplets flying from the nozzles 23 of the print head 24 so as to land on the test box 51. The ink receiving area 52 is provided in the test box 51. The voltage applying circuit 53 applies a voltage between the ink receiving area 52 and the print head 24. The voltage detection circuit 54 detects a voltage that is generated at the ink receiving area 52. The test box 51 is a substantially box-shaped casing having an opening at its top end. The test box 51 is provided at a position that is located to the left-hand side outside a printable area of the platen 44. The ink receiving area 52 is provided inside the test box 51. The ink receiving area 52 includes an upper ink absorber 55, a lower ink absorber 56 and a meshed electrode member 57. The upper ink absorber 55 receives ink droplets that directly land thereon. The lower ink absorber 56 absorbs ink droplets that permeates downward after the ink droplets have landed on the upper ink absorber 55. The electrode member 57 is arranged between the upper ink absorber 55 and the lower ink absorber 56. The upper ink absorber 55 is formed of a conductive sponge so as to have the same electric potential as the electrode member 57. The sponge has high permeability such that landed ink droplets are able to move downward. Here, the sponge employs an ester-based urethane sponge (product name: Ever Light SK-E, manufactured by Bridgestone Corporation). The ink receiving area 52 corresponds to the surface of the upper ink absorber 55. The lower ink absorber 56 holds ink more than the upper ink absorber 55 does. The lower ink absorber 56 is made of non-woven fabric such as felt and, here, uses a non-woven fabric (product name: Kinocloth, manufactured by Oji Kinocloth, Co., Ltd.). The electrode member 57 is formed as a lattice mesh made of stainless metal (for example, SUS). Thus, ink that is once absorbed by the upper ink absorber 55 penetrates through interstices formed in the lattice electrode member 57 to be absorbed and held by the lower ink absorber 56. The length of the ink receiving area 52 in the transport direction is designed to be larger than that of the nozzle array 43. Note that the upper ink absorber 55 and the lower ink absorber 56 may be omitted.

The voltage applying circuit 53 boosts a voltage of several volts applied in an electrical wiring that is routed inside the ink jet printer 20 to a predetermined direct-current voltage Ve of several tens to several hundreds of volts through a booster circuit (not shown), and applies the boosted direct-current voltage Ve to the nozzle plate 27 of the print head 24 through a switch SW. The voltage detection circuit 54 is connected to the nozzle plate 27. The voltage detection circuit 54 integrates and inverting-amplifies a voltage signal of the nozzle plate 27, and then analog/digital converts the signal and outputs the converted signal to the controller 70. Note that the voltage detection circuit 54 and the booster circuit (not shown) are mounted on the head driving substrate 30.

As shown in FIG. 1, the controller 70 is formed of a microprocessor that mainly includes a CPU 72. The controller 70 includes a flash ROM 73, a RAM 74, an interface (I/F) 79 and an input/output port (not shown). The flash ROM 73 stores various processing programs. The RAM 74 temporarily stores and/or saves data. The I/F 79 exchanges information with external devices. The RAM 74 provides a print buffer area in which print data transmitted from a user's PC 10 through the I/F 79 are stored. The controller 70 receives a voltage signal from the voltage detection circuit 54 or a signal indicating the position of the carriage 22 from the linear encoder 25, which are input through an input port (not shown), and receives a print job, or the like, output from the user's PC 10 and input through the I/F 79. In addition, the controller 70 outputs a control signal to the print head 24 (including the mask circuits 47 and the piezoelectric elements 48), a switching signal to the switch SW, a control signal to the head driving waveform generating circuit 60, and a driving signal to the drive motor 33, a driving signal to the carriage motor 34*a*, and the like, through an output port (not shown), and outputs print status information to the user's PC 10, or the like, through the I/F 79.

Figure 6:
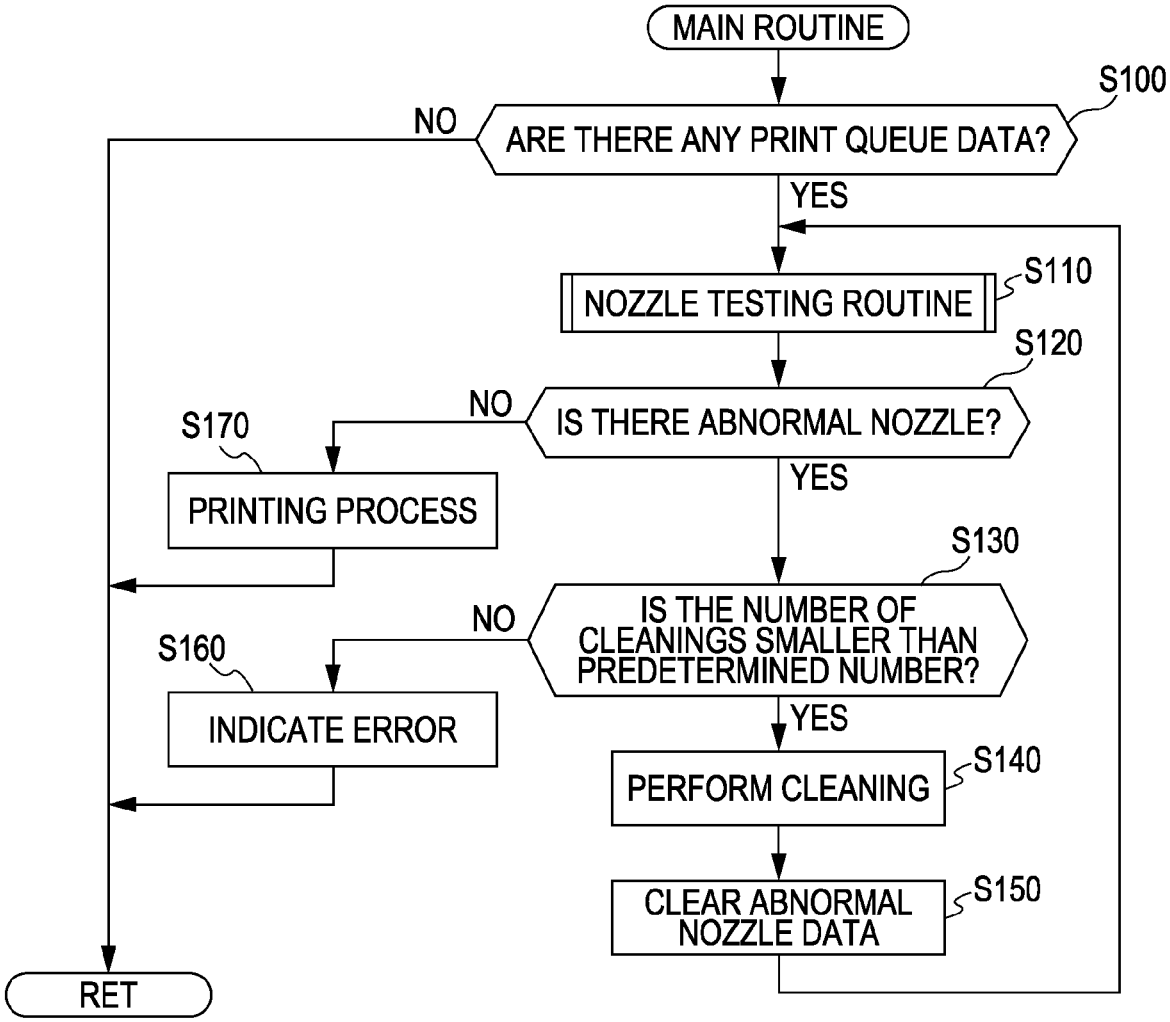
FIG. 6 is a flowchart that shows an example of a main routine.

The operation of the thus configured ink jet printer 20 according to present embodiment will now be described. FIG. 6 is a flowchart that shows an example of a main routine executed by the CPU 72 of the controller 70. The main routine is stored in the flash ROM 73 and is executed by the CPU 72 at predetermined intervals (for example, at intervals of several msec) after the power of the ink jet printer 20 is turned on. As the routine is started, the CPU 72 initially determines whether there are any print queue data (step S100). Here, print data received from the user's PC 10 will be stored in a print buffer area formed in the RAM 74 and become print queue data, so that not only in a case in which printing is being performed when print data are received but also in a case in which printing may be performed immediately, received print data will become print queue data. When it is determined that there are no print queue data in step S100, the routine ends without proceeding to the following steps. On the other hand, in step S100, it is determined that there are print queue data, a nozzle testing routine, which will be described later, is executed (step S110). Although not specifically described here and will be described later in detail, in the nozzle testing routine, if there is an abnormal nozzle in which abnormality such as nozzle clogging is occurring, information that identifies the abnormal nozzle will be stored in a predetermined area of the RAM 74.

Next, it is determined on the basis of the content stored in the predetermined area of the RAM 74 whether there is an abnormal nozzle 23, at which abnormality is occurring, among all the nozzles 23 arrayed on the print head 24 (step S120). If there is an abnormal nozzle 23, cleaning of the print head 24 is performed in consideration of nozzle clogging; however, before that, it is determined whether the number of cleanings is smaller than a predetermined number (for example, three) (step S130). Then, when it is determined that the number of cleanings is smaller than a predetermined number, cleaning of the print head 24 is performed (step S140). Specifically, the carriage 22 is moved by driving the carriage motor 34 so that the print head 24 is located at a home position at which the print head 24 faces the capping device 40, the capping device 40 is operated so that the capping device 40 covers a nozzle forming face of the print head 24, and then a negative pressure from a vacuum pump (not shown) is applied to the nozzle forming face to thereby vacuum and drain clogged ink from the nozzles 23. After the cleaning, information regarding abnormal nozzles, stored in the RAM 74, is cleared (step S150), and the process returns to step S110 in order to test whether abnormal discharge of the nozzles 23 is eliminated. Note that, in step S110, it is applicable that only the nozzles 23 in which abnormality has been occurring are retested; however, nozzle clogging may occur in the nozzles 23 that was normal at the time of cleaning because of some reasons, so that all the nozzles 23 of the print head 24 are retested. On the other hand, when it is determined in step S130 that the number of cleanings is equal to or larger than a predetermined number, it is regarded that the abnormal nozzles would not recover even with a further cleaning, and indicates an error message on an operation panel (not shown) (step S160), after which the main routine ends. In this way, all the nozzles 23 of the print head 24 are tested whether nozzle clogging is occurring and, if nozzle clogging is occurring, cleaning is performed below a predetermined upper limit number to thereby eliminate nozzle clogging.

On the other hand, when it is determined in step S120 that there is no abnormal nozzle 23, that is, ink is able to be discharged from all the nozzles 23, printing process is performed (step S170). The printing process controls the head driving waveform generating circuit 60 to generate the above described original signal ODRVa (see FIG. 3) at the time of normal printing and then alternately repeats a process in which, while the carriage 22 is moved in the main scanning direction by driving the carriage motor 34, the piezoelectric elements 48 of the print head 24 are driven by the driving signals DRVn that are generated from the corresponding printing signals PRTn and original signals ODRVa generated on the basis of a print job to thereby discharge ink and a process in which the paper feed roller 35 is driven for rotation to transport a recording sheet S by a predetermined amount.

Here, how an ink droplet is discharged from the nozzle 23 when the first pulse P1*a* (voltage) is applied to the piezoelectric element 48 as the driving signal DRVn will be described.

When a normal print job is processed, as shown in FIG. 3, in the decompression voltage change in which a voltage applied to the piezoelectric element 48 increases from the normal intermediate voltage Va to the decompression voltage Vb, the piezoelectric element 48 deforms to reduce the pressure in the ink chamber 29, so that, after the decompression voltage change, ink near the nozzle 23 is slightly drawn into the ink chamber 29 (see (a) in FIG. 3). Next, in the process of the pressurization voltage change in which a voltage applied to the piezoelectric element 48 decreases to the pressurization voltage Vp, the piezoelectric element 48 deforms to apply a pressure to the ink chamber 29, so that, after the pressurization voltage change, ink in the ink chamber 29 protrudes from the nozzle 23 (see (b) in FIG. 3). Then, in the separation voltage change in which an applied voltage changes again to the normal intermediate voltage Va, the pressure applied to the ink chamber 29 is released and, owing to the separation voltage change, ink enters a state immediately before being discharged from the nozzle 23 and is located at a printing distance da from the ink receiving area 52 (see (c) in FIG. 3) and then the ink that protrudes from the nozzle 23 is separated from ink that remains in the ink chamber 29 and discharged as an ink droplet (see (d) in FIG. 3). Here, ink will enter a state immediately before being discharged as an ink droplet ((c) in FIG. 3) in the process of the separation voltage change.

Figure 7:
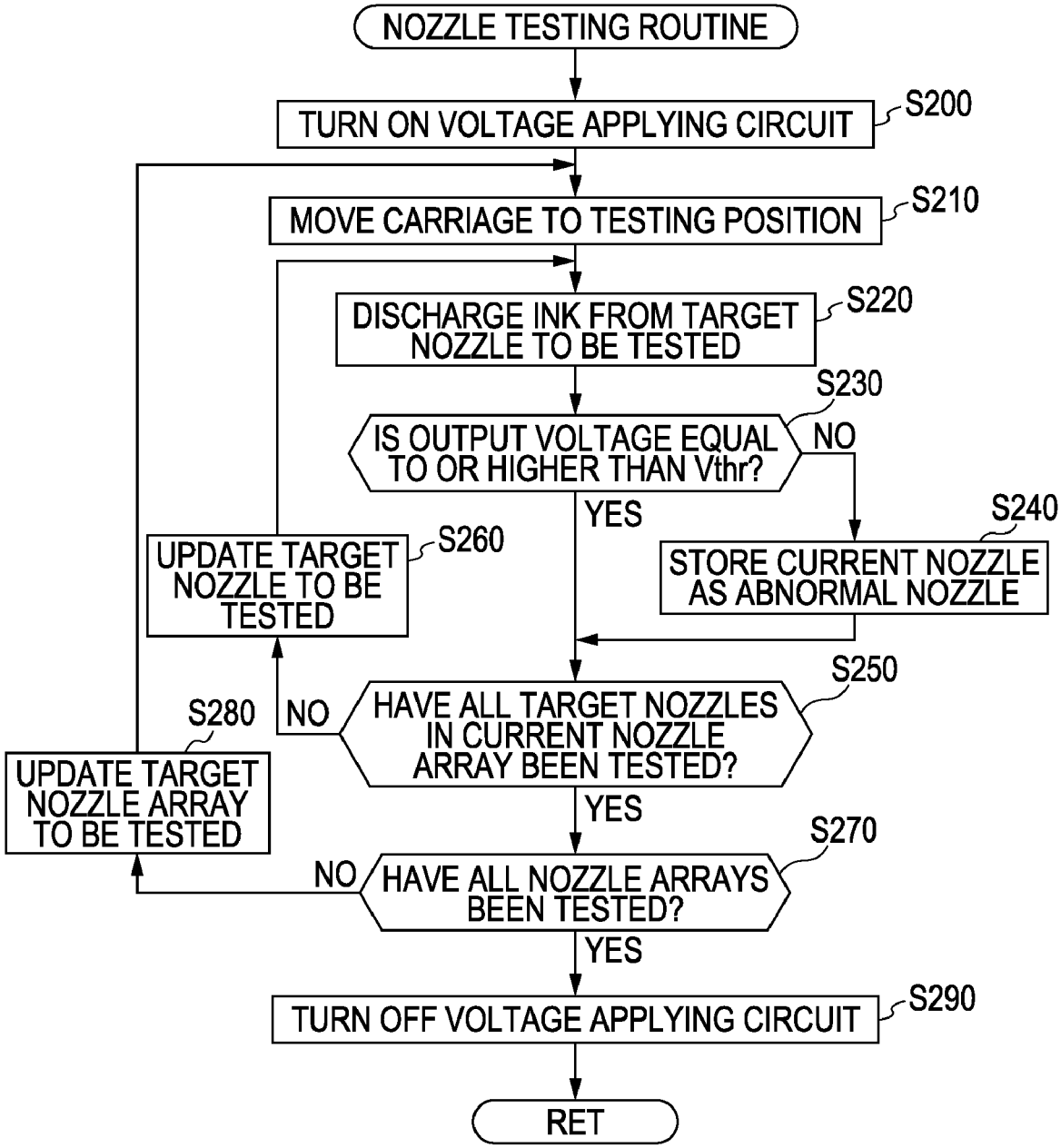
FIG. 7 is a flowchart that shows an example of a nozzle testing routine.

The nozzle testing routine will now be described. As shown in FIG. 7, this routine includes a nozzle testing process that tests whether there is a clogged nozzle 23 arranged on the print head 24, that is, whether ink is able to be discharged from the nozzles 23, and is stored in the flash ROM 73. As the routine is started, the CPU 72 turns on the switch SW of the voltage applying circuit 53 (step S200). Then, the carriage motor 34 is driven to move the carriage 22 so that the target nozzle array 43 to be tested, out of the nozzle arrays 43 of the print head 24, faces a predetermined testing position (step S210), and makes an electrically charged ink droplet be discharged from a nozzle 23 included in the target nozzle array 43 using the mask circuit 47 and the piezoelectric element 48 (see FIG. 2) of the nozzle 23 (step S220). Here, the head is driven by the driving signal DRVn of the target nozzle 23 that is generated from the printing signal PRTn, in which all the pulses P1 to P3 are not masked, and the original signal ODRVb at the time of nozzle testing. In addition, the nozzles 23 are set so as to discharge ink from the nozzle 23, having a smallest nozzle number n, included in the nozzle array 43 at the time of start of testing.

Here, how an ink droplet is discharged from the nozzle 23 when the first pulse P1*b* (voltage) is applied to the piezoelectric element 48 will be described. When nozzle testing is performed, as shown in FIG. 4, in the decompression voltage change in which a voltage applied to the piezoelectric element 48 increases from the test intermediate voltage Vt to the decompression voltage Vb, ink near the nozzle 23 is slightly drawn into the ink chamber 29 as in the case where the normal print job is processed (see (a) in FIG. 4). Next, in the process of the pressurization voltage change in which a voltage applied to the piezoelectric element 48 decreases to the pressurization voltage Vp, ink in the ink chamber 29 protrudes from the nozzle 23 as in the case where the normal print job is processed (see (b) in FIG. 4). Then, in the separation voltage change in which an applied voltage changes again to the test intermediate voltage Vt, the pressure applied to the ink chamber 29 is released; however, at the time of nozzle testing, the voltage changes to the test intermediate voltage that is lower than the normal intermediate voltage. After the separation voltage change, ink enters a state immediately before being discharged as an ink droplet (see (c) in FIG. 4) and then ink that protrudes from the nozzle 23 is separated from ink that remains in the ink chamber 29 and discharged as an ink droplet (see (d) in FIG. 4). Here, because the separation voltage change is smaller and is completed more quickly than the separation voltage change at the time of normal printing (see FIG. 3), separation is not completed in the process of the separation voltage change and, therefore, ink will enter a state immediately before being discharged as an ink droplet ((c) in FIG. 4) slower than that at the time of normal printing. In addition, a distance between ink shown in (c) of FIG. 4 and the ink receiving area 52 when the ink is placed in a state immediately before being discharged as an ink droplet is a testing distance db. Because the amount of the separation voltage change at the time of nozzle testing (difference between Vt and Vp) is smaller than the amount of the separation voltage change at the time of normal printing (difference between Va and Vp) and the protruded ink is hardly separated from ink that remains in the ink chamber 29 at the time of nozzle testing as compared with that at the time of normal printing, the testing distance db is shorter than the printing distance da. That is, the ink that protrudes from the nozzle 23 is located closer to the ink receiving area 52 when the original signal ODRVb at the time of nozzle testing, of which the separation voltage change is smaller, is used than when the protruded ink maintains electrical continuity with ink in the ink chamber 29 and the print head 24. Note that because the amount of the pressurization voltage change is equal between the normal printing and the nozzle testing, the same amount of ink is presumably discharged.

A voltage of the ink receiving area 52 changes from when a negatively charged ink droplet flies from a nozzle 23 until when the ink droplet lands on the ink receiving area 52, and the voltage detection circuit 54 detects this change. This experiment was performed actually, and a voltage detected by the voltage detection circuit 54 showed a sine curve. Although it is not evident that the principle that gives such a sine curve, it is presumably caused by an induced current flowing due to electrostatic induction as an electrically charged ink droplet approaches the ink receiving area 52. Here, nozzle testing may possibly be executed using the original signal ODRVa at the time of printing, as shown in FIG. 3; however, as described above, the ink that protrudes in a state where electrical continuity is maintained with the print head 24 is located at a distance shorter at the time of nozzle testing than at the time of normal printing from the ink receiving area 52, so that the discharged ink droplet will be charged with more electric charges than that when nozzle testing is performed using the same original signal as the original signal ODRVa at the time of normal printing. Thus, it is presumable that the voltage detection circuit 54 detects a further large voltage change at the time of nozzle testing than at the time of normal printing. Next, the CPU 72 determines whether the amplitude or output level of a signal waveform detected by the voltage detection circuit 54 is equal to or larger than a threshold Vthr (step S230). The threshold Vthr is an empirically determined value such that the output level (peak value) of an output signal waveform exceeds the threshold Vthr when 24-shot ink is normally discharged and the output level does not exceed the threshold Vthr when 24-shot ink is not normally discharged because of noise, or the like. Note that the operation to output all the first to third pulses P1, P2 and P3 in one pixel interval, which represents a driving waveform, is performed eight times in order to discharge 24-shot ink droplets. In addition, as the number of ink discharged increases, the output level increases.

Referring back to the nozzle testing routine shown in FIG. 7, when it is determined in step S230 that the output level is lower than the threshold Vthr, the CPU 72 assumes that abnormality such as clogging is occurring in the current nozzle 23 and stores information (for example, information that indicates what number nozzle and which nozzle array) that identifies the nozzle 23 in the RAM 74 (step S240). After step S240 or when it is determined in step S230 that the output level is equal to or higher than the threshold Vthr (that is, when it is determined that the current nozzle 23 is normal), it is determined whether all the nozzles 23 included in the currently testing nozzle array 43 have been tested (step S250). When it is determined that there is an untested nozzle 23 in the currently testing nozzle array, the target nozzle 23 is updated to the untested one (step S260) and, after that, the processes of steps S210 to S260 will be performed again. On the other hand, when it is determined in step S250 that all the nozzles 23 in the currently testing nozzle array have been tested, it is determined whether all the nozzle arrays 43 included in the print head 24 have been tested (step S270). When it is determined that there is an untested nozzle array 43, the target nozzle array 43 is updated to the untested nozzle array 43 (step S280) and, after that, the processes of steps S210 to S280 will be performed. That is, in the processes of steps S210 to S280, the print head 24 is moved to a predetermined testing position, ink is discharged from all the nozzles 23 in each nozzle array 43 and then it is determined whether ink is discharged from the nozzles 23 on the basis of the voltage values detected by the voltage detection circuit 54. On the other hand, it is determined in step S270 that all the nozzle arrays 43 included in the print head 24 have been tested, the CPU 72 turns off the switch SW of the voltage applying circuit 53 (step S290) and ends the routine.

Referring back to the main routine shown in FIG. 6, the CPU 72 performs a printing process in step S170 and then ends the routine. In this way, at the time of normal printing, the print head 24 is driven using the driving signal DRVn that is generated by the original signal ODRVa and the printing signal PRTn, whereas at the time of nozzle testing, the print head 24 is driven using the driving signal DRVn that is generated by the original signal ODRVb such that a distance between protruded ink immediately before being discharged and the ink receiving area 52 is shorter than that at the time of normal printing and the printing signal PRTn such that all the pulses P1 to P3 are not masked.

Here, the correspondence relationship between the components of the present embodiment and the components of the aspects of the invention will be clarified. The ink jet printer 20 of the present embodiment may be regarded as a liquid discharging apparatus according to the aspects of the invention. The print head 24 may be regarded as a discharging device. The ink receiving area 52 may be regarded as a liquid receiving device. The voltage applying circuit 53 may be regarded as a voltage applying device. The voltage detection circuit 54 may be regarded as an electrical change detection device. The head driving waveform generating circuit 60 may be regarded as a driving signal generating device. The controller 70 may be regarded as a control device. The printing signal PRTn may be regarded as discharge data. The recording sheet S may be regarded as a target. The original signal ODRVa at the time of normal printing may be regarded as a discharge data driving signal. The original signal ODRVb at the time of nozzle testing may be regarded as a test driving signal. The ink chamber 29 may be regarded as a liquid chamber.

According to the above described ink jet printer 20 of the present embodiment, ink immediately before being discharged is located closer to the ink receiving area 52 than that based on a normal print job while maintaining electrical continuity with the print head 24, so that when the ink is discharged as an ink droplet thereafter, the ink droplet will be electrically charged with more electric charges than that when the print job is processed. Thus, a voltage change detected by the voltage detection circuit 54 is also larger than that when the print job is processed. Hence, it is possible to effectively obtain a further large detection signal when it is tested whether ink is able to be discharged from the nozzles 23. As a result, it is possible to reduce the number of ink droplets discharged for obtaining a sufficient output level, it is possible to perform testing for a further short period of time, and it is possible to further reliably perform testing. In addition, a further large value may be set as a threshold Vthr, with which it is determined whether ink is discharged, without further reducing the number of ink droplets being discharged, it is possible to prevent erroneous detection due to noise.

In addition, the print head 24 includes the ink chambers 29 that temporarily contain ink and the piezoelectric elements 48, each of which is applied with a voltage corresponding to the original signal ODRVa at the time of normal printing or the original signal ODRVb at the time of nozzle testing to apply a pressure to the corresponding ink chamber 29 to be deformed and makes ink be discharged from the nozzle 23. The head driving waveform generating circuit 60 generates a signal that includes a pressurization voltage change, as the original signal ODRVa at the time of normal printing, that deforms the piezoelectric element 48 to reduce the voltage of the ink chamber 29 and a separation voltage change that, after the pressurization voltage change, separates ink, which will be discharged from the nozzle 23, from ink that remains in the ink chamber 29. The head driving waveform generating circuit 60 generates the original signal ODRVb at the time of nozzle testing of which the ratio of the separation voltage change to the pressurization voltage change is smaller than the ratio of the separation voltage change to the pressurization voltage change of the original signal ODRVa at the time of normal printing. Thus, by using the original signal ODRVb, of which the ratio of the separation voltage change to the pressurization voltage change is relatively small, at the time of nozzle testing, that is, by weakening separation between the ink that remains in the ink chamber 29 and the ink immediately before being discharged, it is possible to relatively easily reduce a distance between the ink immediately before being discharged and the ink receiving area 52 as compared with that at the time of normal printing. Furthermore, because a signal that uses the test intermediate voltage Vt as a reference, that changes to the pressurization voltage Vp through the pressurization voltage change and that changes to the test intermediate voltage Vt is generated as the original signal ODRVa at the time of normal printing, it is possible to drive the print head 24 using the test intermediate voltage Vt as a reference. In addition, it is possible to further easily adjust the degree to which discharged ink is easily separated from ink that remains in the ink chamber 29 only by changing the intermediate voltage between at the time of normal printing and at the time of nozzle testing without changing the decompression voltage Va or the pressurization voltage Vp.

The aspects of the invention are not limited to the above described embodiment, but it may be modified into various forms within the scope of the invention.

Figure 8:
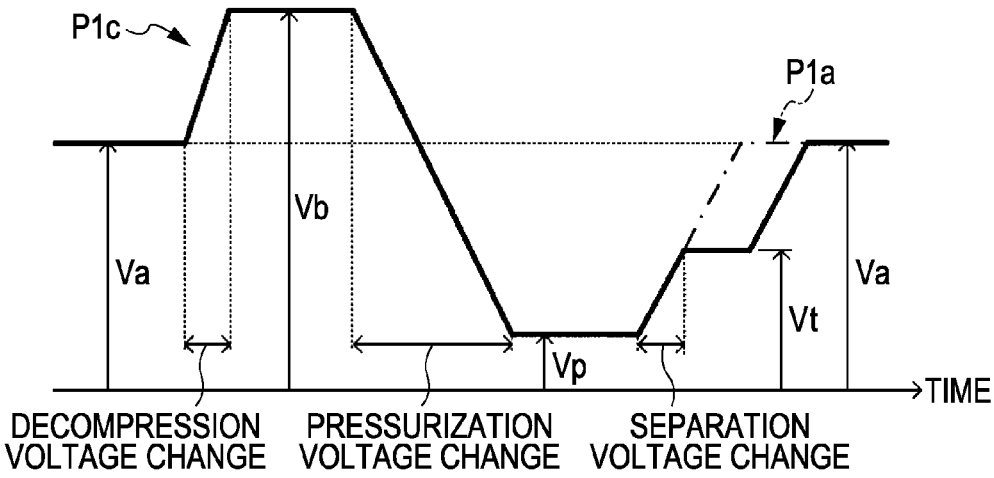
FIG. 8 is a view that illustrates an original signal at the time of another nozzle testing.

For example, in the above described embodiment, the head driving waveform generating circuit 60 generates a signal that includes the first pulse P1*a* that changes from the pressurization voltage Vp to the test intermediate voltage Vt through the separation voltage change and the second pulse and third pulse similar to the first pulse P1*a* as the original signal ODRVb at the time of nozzle testing; however, a signal that includes the first pulse P1*c* shown in FIG. 8 and a second pulse and third pulse similar to the first pulse P1*c* may be generated as the original signal ODRVb at the time of nozzle testing. The first pulse P1*c* uses the normal intermediate voltage Va as a reference, and is set to change from the normal intermediate voltage Va to the decompression voltage Va that is higher than the intermediate voltage Va through the decompression voltage change, change to the pressurization voltage Vp that is lower than the normal intermediate voltage Va through the pressurization voltage change, change from the pressurization voltage Vp to the test intermediate voltage Vt between the pressurization voltage Vp and the normal intermediate voltage Va through the separation voltage change and then change to the normal intermediate voltage Va that is higher than the test intermediate voltage Vt. In this case, it is possible to drive the print head 24 using the normal intermediate voltage Va as a reference. In addition, it is not necessary to vary the normal intermediate voltage Va, decompression voltage Vb or pressurization voltage Vp depending on normal printing or nozzle testing.

Figure 9:
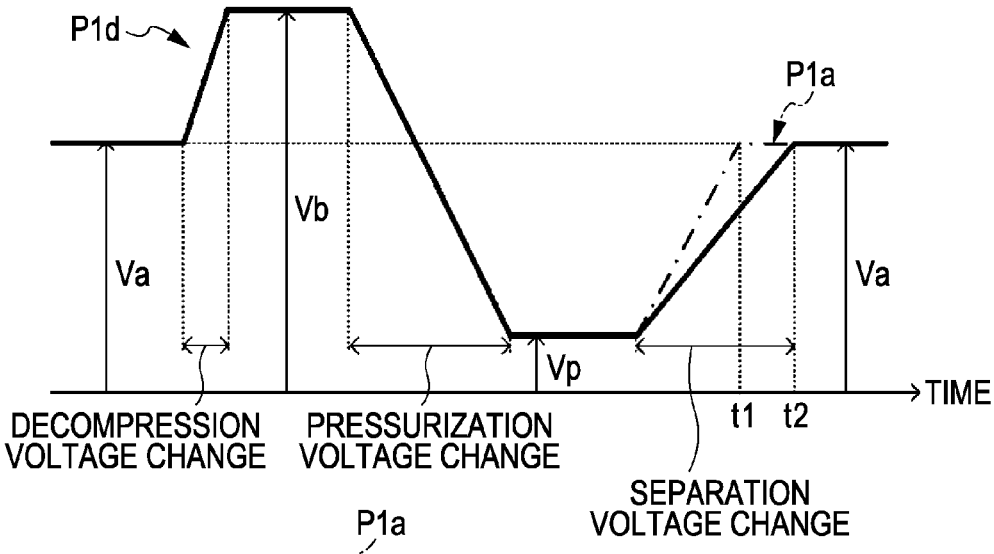
FIG. 9 is a view that illustrates an original signal at the time of further another nozzle testing.

In the above described embodiment, the head driving waveform generating circuit 60 generates a signal that includes the first pulse P1*b* that changes from the pressurization voltage Vp to the test intermediate voltage Vt through the separation voltage change of which the amount per unit time is equal to that of the first pulse P1*a* included in the original signal ODRVa at the time of normal printing and the second pulse and third pulse similar to the first pulse P1*b* as the original signal ODRVb at the time of nozzle testing; however, the original signal ODRVb that includes a first pulse that has a separation voltage change of which the amount per unit time is smaller than the separation voltage change included in the first pulse P1*a* of the original signal ODRVa at the time of normal printing and a second pulse and third pulse similar to the first pulse may be generated. For example, the original signal ODRVb that includes the first pulse P1*d* shown in FIG. 9 and the second pulse and third pulse similar to the first pulse P1*d* may be generated. The first pulse P1*d* is set to change from the normal intermediate voltage Va to the decompression voltage Vb through the decompression voltage change, change to the pressurization voltage Vp through the pressurization voltage change and then change to the normal intermediate voltage Va through the separation voltage change and, in addition, the time at which the separation voltage change ends is set at time t2 that is later than time t1 at which the change ends at the time of normal printing, that is, the amount of the separation voltage change at the time of testing per unit time is set to be smaller than that at the time of normal printing. In this case, at the time of nozzle testing, by using the driving signal DRVn that is generated by using the original signal ODRVb at the time of nozzle testing, which includes the separation voltage change of which the amount per unit time is small, that is, by weakening separation between the ink that remains in the ink chamber 29 and the ink immediately before being discharged, it is possible to relatively easily reduce a distance between the ink immediately before being discharged and the ink receiving area 52 as compared with the time of normal printing.

Figure 10:
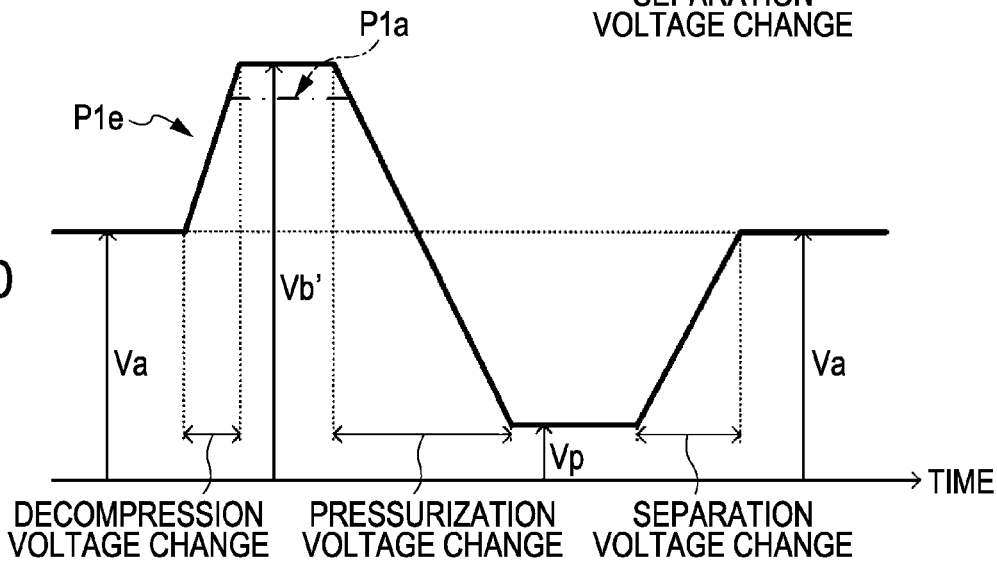
FIG. 10 is a view that illustrates an original signal at the time of yet another nozzle testing.

In the above described embodiment, the head driving waveform generating circuit 60 generates a signal that includes the first pulse P1*b* that includes the pressurization voltage change having the same size as the first pulse P1*a* included in the original signal ODRVa at the time of printing as the original signal ODRVb at the time of nozzle testing and the second pulse and third pulse similar to the first pulse P1*b*; however, the original signal ODRVb that includes a first pulse that includes a pressurization voltage change having a larger size than the pressurization voltage change included in the first pulse P1*a* of the original signal ODRVa at the time of normal printing and a second pulse and third pulse similar to the first pulse may be generated. For example, the original signal ODRVb that includes the first pulse P1*e* shown in FIG. 10 and the second pulse and third pulse similar to the first pulse P1*e* may be generated. The first pulse P1*e* is set to change from the normal intermediate voltage Va to a decompression voltage Vb' that is higher than the decompression voltage Vb through the decompression voltage change, change to the pressurization voltage Vp through the pressurization voltage change and then change to the normal intermediate voltage Va through the separation voltage change and, in addition, the amount of the pressurization voltage change (difference between Vb' and Vp) is set to be larger than the amount of the pressurization voltage change (difference between Vb and Vp) at the time of normal printing. In this case, by using the driving signal DRVn that is generated by using the original signal ODRVb at the time of nozzle testing, of which the pressurization voltage change is relatively large, that is, by increasing the amount of ink that protrudes from the nozzle 23 and immediately before being discharged, it is possible to relatively easily reduce a distance between the ink immediately before being discharged and the ink receiving area 52 as compared with that at the time of normal printing. Note that, in this case as well, the original signal ODRVb at the time of nozzle testing is set so that the ratio of the separation voltage change to the pressurization voltage change is smaller than the ratio of the separation voltage change to the pressurization voltage change of the original signal ODRVa at the time of normal printing.

In the above described embodiment, as shown in FIG. 2, the print head 24 employs a structure such that as a voltage is applied, the piezoelectric element 48 contracts in a direction perpendicular to the top wall of the ink chamber 29 to thereby reduce a pressure applied to ink in the ink chamber 29; however, the print head 24 may employ a structure such that as a voltage is applied, the piezoelectric element 48 contracts in a direction along the top wall of the ink chamber 29 to bend further to thereby apply a pressure to ink in the ink chamber 29. At this time, the original signal ODRV that includes pulses having crests and troughs that are inverted from the first pulse P1*a* included in the original signal ODRVa at the time of normal printing shown in FIG. 3 and the first pulse P1*b* included in the original signal ODRVb at the time of nozzle testing shown in FIG. 4 may be used as the original signal ODRVa at the time of normal printing and the original signal ODRVb at the time of nozzle testing. That is, the original signal ODRV at the time of normal printing employs a signal that includes three pulses that change from a normal intermediate voltage Va' to a decompression voltage Vb' that is lower than the normal intermediate voltage Va' through the decompression voltage change, change to a pressurization voltage Vp' that is higher than the normal intermediate voltage Va' through the pressurization voltage change and then change to the normal intermediate voltage Va' through the separation voltage change, and the original signal ODRV at the time of nozzle testing employs a signal that includes three pulses that change from a test intermediate voltage Vt' between the normal intermediate voltage Va' and the decompression voltage Vb' to a decompression voltage Vb' that is lower than the test intermediate voltage Vt' through the decompression voltage change, change to the pressurization voltage Vt' that is higher than the test intermediate voltage Vt' through the pressurization voltage change and then change to the test intermediate voltage Vt' through the separation voltage change.

In the above described embodiment, in the nozzle testing routine shown in FIG. 6, nozzle testing is performed in such a manner that the print head 24 is negatively charged, the ink receiving area 52 is positively charged, ink is then discharged and a voltage change at that time is detected by the voltage detection circuit 54. Instead, it is applicable that the electrode member 57 and the print head 24 are electrically connected through a direct-current power supply and a resistance element using the voltage applying circuit 53 so that the electrode member 57 is a negative electrode and the print head 24 is a positive electrode, the voltage detection circuit 54 is connected to detect a voltage of the print head 24, the CPU 72 executes processes in accordance with the above described nozzle testing routine and then tests on the basis of the detected voltage change whether ink is discharged from the nozzle. In this case as well, it is possible to effectively obtain a further large detection signal when it is tested whether ink is able to be discharged from the nozzles.

In the above described embodiment, the nozzle testing routine is executed when there are any print queue data in step S110 in the main routine; however, the nozzle testing routine may be, for example, executed every time the number of movements of the carriage 22 reaches a predetermined number (for example, every 100 paths, or the like), may be executed at predetermined intervals (for example, every day, every week, or the like), or may be executed in accordance with instructions received from the user through operating an operation panel (not shown). In addition, the nozzle testing routine may be executed when the ink jet printer 20 is tested before shipment.

In the above described embodiment, a mechanism that discharges ink using the piezoelectric elements 48 is employed; however a mechanism that discharges ink is not limited to this mechanism. For example, a mechanism that conducts an electric current to a heater to discharge ink using generated bubbles may be employed. In this case, an electrical signal that drives the heater may be generated and used so that ink is discharged as in the case shown in (a) to (d) in FIG. 3 at the time of normal printing and ink that protrudes from the nozzle is located closer to the ink receiving area than that at the time of normal printing and is then discharged as an ink droplet as in the case shown in (a) to (d) in FIG. 4 at the time of nozzle testing. In this case as well, it is possible to effectively obtain a further large detection signal when it is tested whether ink is able to be discharged from the nozzles.

In the above described embodiment, the print head 24 is moved in the main scanning direction by the carriage belt 32 and the carriage motor 34 to perform printing; however, the aspects of the invention may be applied to the one in which the print head 24 is not moved in the main scanning direction. Specifically, a print head (so-called line ink jet head, which is, for example, described in JP-A-2002-200779) provides nozzle arrays of colors that are arrayed in the main scanning direction perpendicular to the transport direction of the recording sheet S with the length equal to or larger than the width of the recording sheet S, and the print head may be applied to discharge ink onto the recording sheet S. At this time, the ink receiving area 52 of the nozzle test device 50 is formed to have a size by which ink discharged from the nozzle arrays 43 of colors is able to be received. In this case as well, it is possible to effectively obtain a further large detection signal when it is tested whether ink is able to be discharged from the nozzles.

In the above described embodiment, the liquid discharging apparatus is exemplified as the ink jet printer 20; however, the liquid discharging apparatus may be exemplified as a printer that discharges a liquid body (fluid dispersion) in which liquid or particles of functional material, other than ink, are dispersed or a flowage body such as gel or may be exemplified as a printer that discharges solid that may be discharged as a fluid. For example, the aspects of the invention may be embodied as a liquid discharging apparatus, which discharges liquid that dissolves materials, such as electrode materials or color materials, used for manufacturing a liquid crystal display, an electroluminescence (EL) display, a field emission display and a color filter, or the like, a liquid body discharging apparatus, which discharges liquid body in which the above materials are dispersed or a liquid discharging apparatus, which discharges liquid as a sample, used as a precision pipette. Furthermore, the liquid discharging apparatus may be a liquid discharging apparatus that discharges a transparent resin liquid, such as an ultraviolet curing resin, for forming a microscopic semi-spherical lens (optical lens) used for an optical communication element, or the like, on a substrate, or a flowage discharging apparatus that discharges a gel.

What is claimed is:

1. A liquid discharging apparatus comprising:

a discharging device that is able to discharge liquid from a nozzle;

a liquid receiving device that receives liquid discharged from the nozzle;

a voltage applying device that applies a predetermined voltage between the discharging device and the liquid receiving device;

an electrical change detection device that detects at least one of an electrical change in the discharging device and an electrical change in the liquid receiving device;

a driving signal generating device that generates a predetermined discharge data driving signal to drive the discharging device at the time of printing and a test driving signal to drive the discharging device at a time of nozzle testing in which it is tested whether the liquid is able to be discharged from the nozzle;

wherein the discharging device discharges liquid from the nozzle to a target on the basis of discharge data at the time of the printing;

wherein the discharging device discharges liquid from the nozzle to the liquid receiving device at the time of the nozzle testing, so that the liquid immediately before being discharged from the nozzle protrudes from the nozzle while maintaining electrical continuity with the discharging device;

wherein the test driving signal causes the liquid to protrude from the nozzle a distance that is greater than a distance that the discharge data driving signal causes the liquid to protrude from the nozzle;

wherein the test driving signal is not generated at the time of printing; and a control device that, at the time of printing controls the discharging device so as to perform discharging on the basis of the discharge data using the generated discharge data driving signal and that, at the time of the nozzle testing, controls the voltage applying device so as to apply the predetermined voltage between the discharging device and the liquid receiving device and that controls the discharging device using the generated test driving signal to determine on the basis of an electrical change detected by the electrical change detection device whether the liquid is discharged to thereby perform the nozzle testing.

2. The liquid discharging device according to claim 1, wherein the discharging device includes: a liquid chamber that is in fluid communication with the nozzle and that temporarily contains the liquid; and a piezoelectric element that deforms the liquid chamber by applying a pressure to the liquid chamber in such a manner that a voltage based on the discharge data driving signal or the test driving signal is applied to the piezoelectric element to thereby make the liquid be discharged from the nozzle, wherein the driving signal generating device generates an electrical signal that includes, as the discharge data driving signal, a pressurization voltage change that makes the piezoelectric element deform so as to reduce the volume of the liquid chamber and a separation voltage change that, after the pressurization voltage change, separates liquid, which will be discharged from the nozzle, from liquid that remains in the liquid chamber, and generates an electrical signal that includes, as the test driving signal, a pressurization voltage change that makes the piezoelectric element deform so as to reduce the volume of the liquid chamber and a separation voltage change that, after the pressurization voltage change, separates liquid, which will be discharged from the nozzle, from liquid that remains in the liquid chamber, the electrical signal having a ratio of the separation voltage change to the pressurization voltage change in the test driving signal, which is smaller than a ratio of the separation voltage change to the pressurization voltage change in the discharge data driving signal.

3. The liquid discharging device according to claim 2, wherein the driving signal generating device generates, as the discharge data driving signal, an electrical signal that changes to a pressurization voltage, which is a voltage after the pressurization voltage change, through the pressurization voltage change and then changes to a predetermined discharge data intermediate voltage through the separation voltage change, and generates, as the test driving signal, an electrical signal that changes to a pressurization voltage, which is a voltage after the pressurization voltage change, through the pressurization voltage change and then changes to a test intermediate voltage, which is a voltage between the pressurization voltage and the discharge data intermediate voltage, through the separation voltage change, so that the ratio of the separation voltage change to the pressurization voltage change in the test driving signal is smaller than the ratio of the separation voltage change to the pressurization voltage change in the discharge data driving signal.

4. The liquid discharging device according to claim 3, wherein the driving signal generating device generates, as the test driving signal, an electrical signal that uses the discharge data intermediate voltage as a reference, and that changes to the pressurization voltage through the pressurization voltage change, changes to the test intermediate voltage and then changes to the discharge data intermediate voltage.

5. The liquid discharging device according to claim 3, wherein the driving signal generating device generates, as the test driving signal, an electrical signal that uses the test intermediate voltage as a reference, and that changes to the pressurization voltage through the pressurization voltage change and then changes to the test intermediate voltage.

6. The liquid discharging device according to claim 1, wherein the discharging device includes: a liquid chamber that is in fluid communication with the nozzle and that temporarily contains the liquid; and a piezoelectric element that deforms the liquid chamber by applying a pressure to the liquid chamber in such a manner that a voltage based on the discharge data driving signal or the test driving signal is applied to the piezoelectric element to thereby make the liquid be discharged from the nozzle, wherein the driving signal generating device may generate an electrical signal that includes, as the discharge data driving signal, a pressurization voltage change that makes the piezoelectric element deform so as to reduce the volume of the liquid chamber and a separation voltage change that, after the pressurization voltage change, separates liquid, which will be discharged from the nozzle, from liquid that remains in the liquid chamber, and generates an electrical signal that includes, as the test driving signal, the separation voltage change of which the amount per unit time is smaller than that of the separation voltage change included in the discharge data driving signal.

7. The liquid discharging device according to claim 1, wherein the discharging device includes: a liquid chamber that is in fluid communication with the nozzle and that temporarily contains the liquid; and a piezoelectric element that deforms the liquid chamber by applying a pressure to the liquid chamber in such a manner that a voltage based on the discharge data driving signal or the test driving signal is applied to the piezoelectric element to thereby make the liquid be discharged from the nozzle, wherein the driving signal generating device generates an electrical signal that includes, as the discharge data driving signal, a pressurization voltage change that makes the piezoelectric element deform so as to reduce the volume of the liquid chamber in order to push out liquid, which will be discharged from the nozzle, from the liquid chamber, and generates an electrical signal that includes, as the test driving signal, a pressurization voltage change of which the amount is larger than that of the pressurization voltage change included in the discharge data driving signal.

8. A method of controlling a liquid discharging apparatus having a discharging device that is able to discharge liquid from a nozzle to a target and a liquid receiving device that receives liquid discharged from the nozzle, the method comprising:

at a time of printing, generating a predetermined discharge data driving signal to drive the discharging device;

at a time of nozzle testing in which it is tested whether the liquid is able to be discharged from the nozzle, generating a test driving signal to drive the discharging device;

wherein the discharging device discharges liquid from the nozzle to a target on the basis of discharge data at the time of the printing;

wherein the discharging device discharges liquid from the nozzle to the liquid receiving device at the time of the nozzle testing, so that the liquid immediately before being discharged from the nozzle protrudes from the nozzle while maintaining electrical continuity with the discharging device;

wherein the test driving signal causes the liquid to protrude from the nozzle a distance that is greater than a distance that the discharge data driving signal causes the liquid to protrude from the nozzle;

wherein the test driving signal is not generated at the time of printing;

at the time of printing, controlling the discharging device so as to perform discharging on the basis of the discharge data using the generated discharge data driving signal; and at the time of the nozzle testing, applying a predetermined voltage between the discharging device and the liquid receiving device and controlling the discharging device using the generated test driving signal to determine on the basis of at least one of an electrical change in the discharging device and an electrical change in the liquid receiving device whether the liquid is discharged to thereby perform the nozzle testing.

* * * * *